United States Patent [19]

Johnston et al.

[11] Patent Number: 4,668,413

[45] Date of Patent: May 26, 1987

[54] PRESERVATIVE OIL FOR METAL SURFACES AND METHOD

[75] Inventors: Alan A. Johnston; John P. Cuellar, Jr., both of San Antonio, Tex.

[73] Assignee: Tenneco, Inc.

[21] Appl. No.: 830,855

[22] Filed: Feb. 19, 1986

[51] Int. Cl.[4] ..... C10M 129/70

[52] U.S. Cl. ..... 252/56 R

[58] Field of Search ..... 252/56 R

[56] References Cited

U.S. PATENT DOCUMENTS 3,849,323 11/1974 Hollinshead ..... 252/56 R
4,108,785 8/1978 Sturwold ..... 252/56 R
4,525,287 6/1985 Carstensen ..... 252/56 R X
4,557,841 12/1985 Arndt ..... 252/56 R X

*Primary Examiner*—William R. Dixon, Jr.
*Assistant Examiner*—E. M. McAvoy
*Attorney, Agent, or Firm*—Sigalos & Levine

[57] ABSTRACT

The invention comprises a preservative composition for metal surfaces comprising at least one substance known to function to protect metal surfaces against corrosion and a jojoba oil compound in an amount sufficient to form a matrix entrapping and maintaining said protective substance on said metal surfaces, and the method of protecting metal surfaces against corrosion utilizing the composition.

6 Claims, No Drawings

PRESERVATIVE OIL FOR METAL SURFACES AND METHOD

BACKGROUND OF THE INVENTION

Corrosion of metals is the destructive attack on the metal by the environment, by chemical, or by electrochemical processes with the most common kind of corrosion being that due to the reaction of atmospheric components such as oxygen with the metal. Rusting is an example of such corrosion.

In addition to oxygen, there are many pollutants in the atmosphere, such as ozone, nitrogen oxides, nitric acid, sulfur dioxide, sulfuric acid, carbonic acid, hydrochloric acid, tar acids and the like, which act to dissolve the metal surfaces and to pit the same.

Generally, the greater the relative humidity the greater the degree of corrosion. Metals subjected to immersion in water, such as seawater, rapidly corrode.

Efforts to prevent such corrosion include painting, plating, or otherwise coating the metal with corrosion-inhibiting materials such as the conventional chromate and zinc compounds used for that purpose. However, for many metal surfaces painting or other form of permanent or semi-permanent coating is not possible. Such is the case with the inner surfaces of internal combustion engines, for example. In such instances, it is common to use lubricating oils which contain conventional oxidation and rust inhibitors to prevent corrosion. While generally satisfactory for engines, such as automotive or aviation engines, which are in use on a regular basis; i.e., daily or at least several times a month, such inhibitors are generally ineffective for protecting the interior surfaces of such engines if the engines stand idle for long periods of time.

This lack of use is typical of agricultural equipment, lawn mowers, leaf blowers, snowthrowers, snowmobiles, outboard engines, stockpiled replacement engines, and many military vehicles which are stored for long periods of time without use. Despite the use of conventional preservative oils containing known corrosion inhibitors, the internal metal surfaces of such engines corrode and can become so damaged as to become unusable. This is due to the fact the preservative materials will either evaporate or drain off, particularly from vertical surfaces.

Efforts to overcome such corrosion problems include a regular maintenance schedule of starting and running the engines in an effort to keep the internal engine surface coated with preservatives. Such procedure is not only costly, but in many cases not possible. This is true in military depots and car manufacturing facilities where such a large number of vehicles and/or engines remain idled for a long period of time. In addition, such sporadic running of the engines cannot always assure that the metal surfaces will be coated sufficiently with preservatives to prevent corrosion damage.

The ineffectiveness of present preservative fluids is also true with respect to the other types of metal surfaces to which they are applied.

SUMMARY OF THE INVENTION

The present invention overcomes the noted problems to provide enhanced retention of preservative oils on metal surfaces.

Briefly, the present invention provides a preservative composition for metal surfaces comprising at least one substance known to function to protect metal surfaces against corrosion and a jojoba oil compound in an amount sufficient to form a matrix entrapping and maintaining said at least one protective substance on said metal surfaces.

The invention also comprises the method of preserving a metal surface against corrosion utilizing said composition as hereinafter set forth.

DETAILED DESCRIPTION

The key and essential component of the present invention is a jojoba oil compound. As used herein, the term "a jojoba oil compound" means jojoba oil as it is derived from jojoba (*Simmondsia chinensis*), partially and fully hydrogenated.

The type and concentration of particular jojoba oil compounds used in the composition will depend upon the use to which it is to be put. Thus, to protect metal surfaces from seawater, a jojoba oil hydrogenated to a semisolid or solid state can be utilized. For internal combustion engines desired to be protected during long-term storage, a partially hydrogenated jojoba oil; one having a viscous or syrupy consistency, can be used. Such an oil will flow readily once the engine is started and can thereby be readily removed from the engine if desired.

Hydrogenation of the jojoba oil is carried out using conventional procedures commonly practiced for it and other oils and the degree of hydrogenation will vary dependent upon the state; solid, semi-solid, and the like, desired for the use to which the product is to be utilized as discussed above.

It is preferred to fully hydrogenate the jojoba oil; thus forming a hard wax-like material, and to then add an amount of jojoba oil sufficient to form a blend having the viscosity desired.

The other essential component of the composition is a known anti-corrosion agent or mixture of such agents. Examples are commercially sold anti-corrosion additives such as zinc salicylate, zinc dialkyldithiophosphate, sodium sulfonate, calcium sulfonate, and the like. If the preservative substance itself is a fluid, a jojoba oil compound can simply be incorporated therewith. The amount of anti-corrosion substance added is that required to give the longest term anti-corrosion activity and can be readily determined by those skilled in this art. It will also be evident that the amount used will depend upon the severity of the environmental factors acting upon the metal; e.g., greater amounts for metals exposed to seawater as opposed to metals subject only to dry desert conditions.

However, it is deemed most expedient to admix a jojoba oil compound and the preservative substance with a conventional lubricating oil as the carrier. This is particularly true with internal combustion engines where it is desired to coat the interior surfaces. The particular lubricating oil used is that commonly used for the engine to be protected. Thus, for automobile engines an SAE 10W to 10W-40 lubricating oil can be used; for gears an SAE 80W-90 to 85W-140, for turbines one having a viscosity of about 5.0 to 9.9 centistokes @ 100° C.; and for reciprocating aircraft engines grade 80 or grade 120. These examples are illustrative since the most desirable lubricating oil for any particular engine has readily available information from the manufacturer. There are also those oils conforming to military specifications for engine oils; the MIL-L-21260 specification oils.

For anti-corrosion activity against metal surfaces other than the interior of internal combustion engines, the mixture of a jojoba oil compound and preservative substance alone can be utilized with the amount of the jojoba oil compound varied dependent upon the location and shape of the metal surface to be protected. For surfaces to be exposed to the action of corrosive liquids such as seawater and/or which tend toward the vertical, it is obviously preferred to use the more solid jojoba oil compound to prevent drain-off and/or evaporation.

The proportions of known anti-corrosion or protective substance and jojoba oil compound can vary widely dependent upon the particular metal surface to be protected. For surfaces exposed to salt water it is preferred to use a high level of protective substance and a much lower level when the surface to be protected is subjected only to low levels of humidity. Generally, the amount of jojoba oil compound is that required to form a matrix on the metal surface to be protected so as to entrap the protective substance and maintain it in contact with the metal surface. Mixing of the jojoba oil compound and anti-corrosive agent is sufficient to disperse the agent throughout the composition and entrap it in the jojoba oil compound. This entrapment is what is referred to herein as a matrix.

Generally, an effective matrix can be formed utilizing from about 5 to 10 parts by weight of jojoba oil compound for each 100 parts by weight of the composition. It will be evident that the concentration of jojoba oil compound can be greatly increase; to levels of 50 to 90 parts by weight, for such uses where the protective composition need not be pumpable and a harder protective coating is desired.

The amount of anti-corrosion substance or substances added can vary widely depending upon the particular metal to be protected, the length of storage, and the like factors.

In circumstances where the active components are to be admixed with a carrier for use, such as with a lubricating oil, so as to be more easily used to coat the interior of an internal combustion engine by adding to the oil system and pumping it throughout the engine, the amount of active components added is readily calculable after determining the area of the engine to be coated.

The method of protecting the metal surfaces is evident from the foregoing system. For internal metal surfaces, such as engines, the preservative composition utilizing a conventional lubricating oil as the carrier can be applied by pumping it throughout the engine. For other and exposed surfaces the preservative composition can be applied by dipping the metal therein, spraying the composition thereon, or brushing it on the surface.

The invention will be further described in connection with the following examples which are set forth for purposes of illustration only.

EXAMPLE 1

A series of polished mild steel specimens were prepared. One group was coated with a qualified military specification anti-corrosion oil; MIL-L-21260 oil containing zinc salicylate, and the second group was coated with the same oil containing 7% by weight of 100% hydrogenated jojoba oil. The coating was effected by dipping the specimens in the respective coatings.

All the specimens were then placed in synthetic seawater heated to 100° F. for 24 hours while the water was stirred.

The specimens were examined after 24 hours and the specimens coated only with MIL-L-21260 oil had severe corrosion over 60% of the metal surface. The specimens coated with a combination of jojoba oil and MIL-L-21260 showed no corrosion.

EXAMPLE 2

The humidity cabinet procedure specified in Method 5329 of FTMS 791 was followed utilizing SAE Grade 1010 mild steel panels coated with a composition containing 85% by weight paraffinic base oil, 10% by weight hydrogenated jojoba compound, and 5% by weight of a mixture of zinc salicylate and calcium sulfonate.

After being subjected to such treatment for 5 weeks the panels were examined and they exhibited no rust.

EXAMPLE 3

A series of mild steel panels were exposed to ambient outdoor conditions in San Antonio, Tex., for a period of 30 days. During that time the daytime temperature was a least 90° F. each day; the nights, of course, being cooler, and the panels were exposed to both direct sunshine and rain.

One group of the panels was painted with a MIL-L-21260 oil containing zinc salicylate and the second group of panels was painted with a composition containing 90% by weight of the same MIL-L-21260 oil and 5% by weight of a hydrogenated jojoba oil compound; the consistency of the latter composition being that of a very light grease.

The panels coated only with the MIL-L-21260 oil started rusting within four days, whereas the panels coatted with the same oil and the jojoba oil compound showed no rust after 30 days exposure.

While the invention has been described in connection with a preferred embodiment; protection of internal combustion engines, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. A preservative composition for metal surfaces comprising at least one substance known to function to protect metal surfaces against corrosion and a hydrogenated jojoba oil in an amount sufficient to form a matrix entrapping and maintaining said protective substance on said metal surfaces.

2. The preservative composition of claim 1 including a lubricating oil as a carrier.

3. The preservative composition of claims 1 or 2 wherein said hydrogenated jojoba oil is a fully hydrogenated jojoba oil present in said composition in an amount of at least about 5 parts by weight for each 100 parts by weight of the composition.

4. The composition of claims 1 or 2 wherein said composition has a viscosity such that it can be pumped.

5. The method of protecting a metal surface against corrosion comprising applying to said surface the composition of claims 1 or 2 in an amount sufficient to coat said surface.

6. The method of protecting the interior surfaces of an internal combustion engine normally lubricated by a lubricating oil comprising pumping through said engine to distribute throughout the oil lubricating system of said engine a composition consisting essentially of a lubricating oil that is standard for said engine, a hydrogenated jojoba oil, and an anti-corrosion agent; said composition having a viscosity such that it can be pumped and containing from about 5 to 10 parts by weight of said jojoba oil for each 100 parts by weight of the composition.

* * * * *